United States Patent [19]

Rose

[11] 4,238,948

[45] Dec. 16, 1980

[54] CRIMPING AND CUTTING TOOL

[75] Inventor: Edwin J. Rose, Fareham, England

[73] Assignee: Elite Engineering Limited, England

[21] Appl. No.: 13,912

[22] Filed: Feb. 22, 1979

[51] Int. Cl.[3] ..... B21F 5/00; B25B 25/00

[52] U.S. Cl. ..... 72/332; 72/410; 29/739; 140/123; 7/129

[58] Field of Search ..... 72/326, 410, 332, 334, 72/324, 337, 452, 453.15, 453.16, 338; 7/107, 129, 131, 132, 134; 29/747, 750, 751, 628, 630 A, 630 F, 739; 140/123

[56] References Cited

U.S. PATENT DOCUMENTS

| | | | |
|---|---|---|---|
| 2,396,562 | 3/1946 | Forss | 72/410 X |
| 2,783,483 | 3/1957 | Seher | 72/332 X |
| 2,955,624 | 10/1960 | Ferm | 140/123 |
| 2,997,911 | 8/1961 | Hopkins et al. | 7/129 X |
| 3,141,492 | 7/1964 | Petree et al. | 72/326 |
| 3,552,451 | 1/1971 | Pawloski | 72/326 X |
| 3,646,659 | 5/1972 | Ragard | 29/739 |
| 3,854,202 | 12/1974 | Cortese | 7/5.5 X |
| 3,965,719 | 6/1976 | Hays | 72/410 |

*Primary Examiner*—Milton S. Mehr

*Attorney, Agent, or Firm*—Ostrolenk, Faber, Gerb & Soffen

[57] ABSTRACT

This invention relates to an improved crimping and cutting tool in which the tool comprises a pair of relatively moveable jaws ($17_L \cdot 17_R$) means ($13_2 \cdot V_1 14_A$) for closing said jaws to form a small crimping gap (gi) when wire is therebetween and a moveable cutting blade ($16_1$) that wipes the said gap to cut the wire.

11 Claims, 10 Drawing Figures

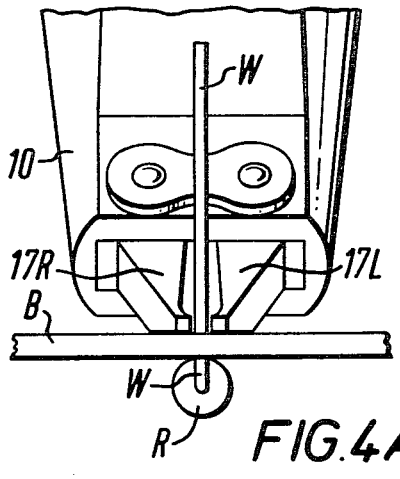
FIG.4A1
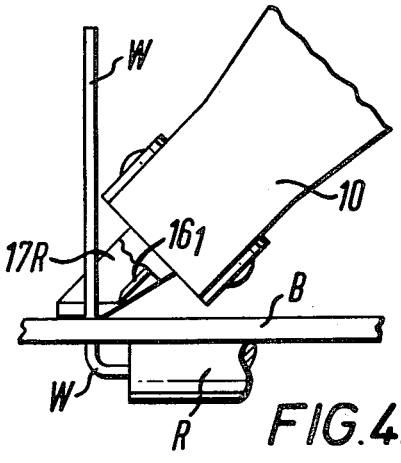
FIG.4A11
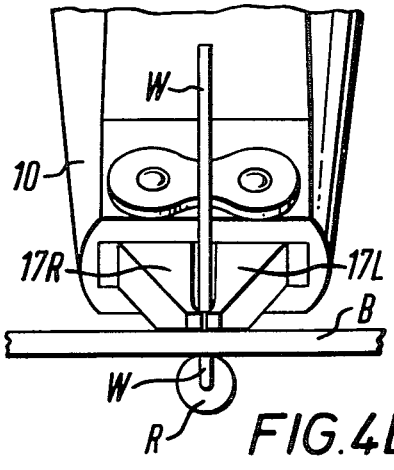
FIG.4B1
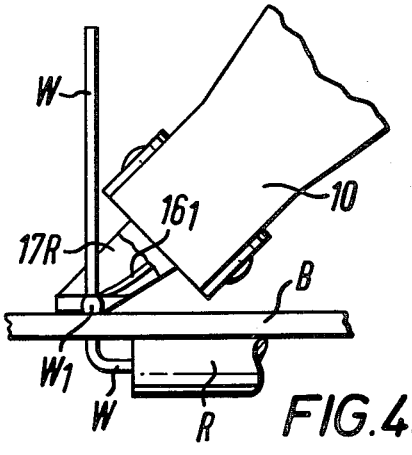
FIG.4B11
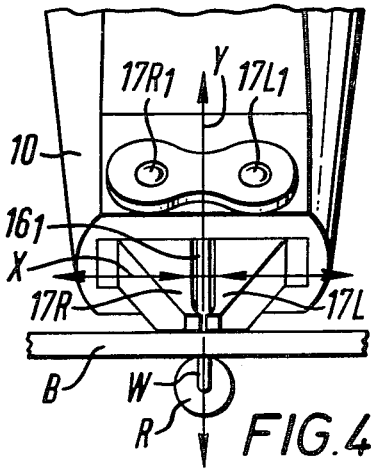
FIG.4C1
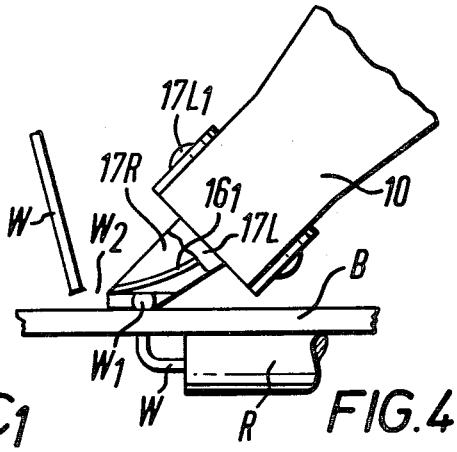
FIG.4C11

CRIMPING AND CUTTING TOOL

DESCRIPTION

This invention relates to a crimping and cutting tool and especially to a crimping tool used for the securing of a wire by crimping to a circuit-board in which the wire once it is passed through the board is compressed or pinched to secure it to the board prior to electrical connections being made, generally by soldering.

According to the present invention we provide a crimping and cutting tool comprising a pair of relatively moveable jaws, means for closing said jaws in use to crimp a wire therebetween to form a crimping gap and a moveable cutting blade that wipes the said gap.

In use one such crimping tool closes the jaws about a wire therebetween to form a crimping gap and the cutting blade then wipes the said gap to sever the crimp per se in the said wire where the thickness of the wire is much reduced by the crimp.

In a preferred construction of a crimping and cutting tool the jaws and the blade move orthogonally to each other and the blade is constrained during its wiping and cutting action in a groove within the jaws. Part of said grooves is in each jaw and substantially symmetrical of the centre line of the jaws, said centre line being substantially co-incident with the centre of a wire between the jaws. The crimping tool of the invention is generally a hand tool.

The invention will be more fully understood from the following description given by way of example only in relation to the figures of the accompanying drawing in which.

Figure 1:
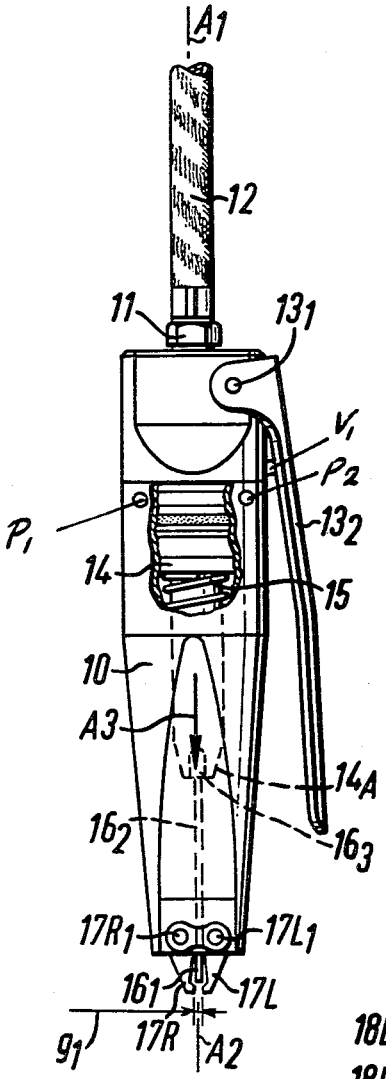
FIG. 1 is a side elevation of a hand crimping and cutting tool.

FIGS. $4A_1$, $4A_{11}$, $4B_1$, $4B_{11}$, $4C_1$, $4C_{11}$ are enlarged sequential views showing the jaws and cutting blade of the tool of FIG. 1 in action; FIGS. $4A_{11}$, $4B_{11}$, $4C_{11}$ being side views of FIGS. $4A_1$, $4B_1$, $4C_1$ with one jaw removed.

Figure 5:
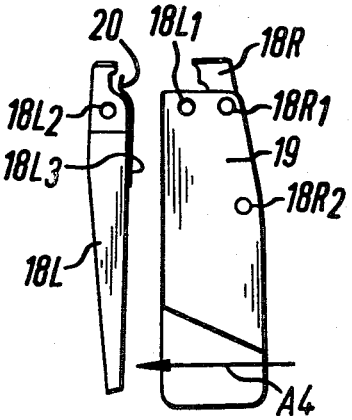

FIG. 5 is a view of an alternative jaw and cutting blade assembly.

Referring now specifically to the several figures of the drawings.

In FIG. 1 a hand crimping and cutting tool is seen to comprise a housing 10 terminated at one end by a connection 11 for a pneumatic hose 12. Pivoted to the housing at $13_1$ is an operating handle grip $13_2$ that actuates a pneumatic valve shown in part at $V_1$. The handle grip $13_2$ may be rotated about axis $A_1A_2$ by virtue of a sealed spigot not shown that co-operates, by a groove not shown, with opposed pins $P_1P_2$, to suit the manual dexterity of the operator. Once air pressure is applied for the working of the tool the position of the handle is locked by said air pressure on the rotating parts. Inside the housing is a piston 14 co-operating with a helical return spring 15. The piston has a tapered end 14A shown in dotted lines in FIG. 1 that acts upon inclined surfaces $17_{51}$, $17_{511}$ of two jaws (to be described below) and receives centrally within itself piston abutment member $16_3$ of a cutting blade $16_1$ (FIG. 3); only the cutting blade $16_1$ being visible in FIG. 1. Two jaws, a left-hand jaw 17L and a right-hand jaw 17R are each pivoted individually at $17L_1$, $17R_1$ in the housing 10 and are brought together by the interpenetration of the piston 14.

Figure 2:
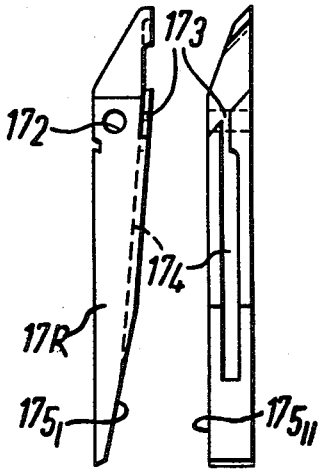
FIG. 2 is an enlarged view, of the underside of one jaw of the tool of FIG. 1, shown in third angle orthographic projection.
Figure 3:
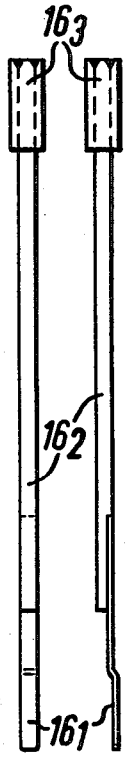
FIG. 3 is an enlarged view, of inter alia the cutting blade of the tool of FIG. 1 shown in 3rd angle orthographic projection.

In FIG. 2 the right-hand jaw 17R is shown more clearly. It is made of steel or some other strong material and has the form shown with a pivot hole at $17_2$ and a groove at $17_3$ which is in effect a half groove since it co-operates with a similar half groove in the complementary jaw 17L. It is along this groove that the cutting blade $16_1$ slides to wipe for example small gap g1 assuming a wire is crimped therebetween and to cut across a crimped wire therebetween. The jaw has a working tapered surface $17_4$ which co-operates with a plunger $16_2$ (FIG. 3). In FIG. 3 the cutting blade $16_1$ is seen to be the end part of the plunger $16_2$ which terminates at that end that co-operates with the piston 14 in a piston abutment member $16_3$. The *modus-operandi* of the crimping tool of FIGS. 1, 2 and 3 is shown in FIGS. $4A_1$ to FIG. $4C_{11}$ inclusive. A board B has a wire W of a resistor R or other component fed through it. The wire is accepted by the jaws 17L, 17R which when closed by actuation of handle grip $13_2$ crimp the wire W at $W_1$ (FIG. $4B_{11}$) and secure it to the board B. The movement of plunger $16_2$ (moving in the direction of arrow A3 FIG. 1) then crops the wire to a predetermined length.

It will be clear from FIG. 1 and FIGS. $4A_1$ to $4C_{11}$ inclusive that the cutting blade $16_1$ moves in action orthogonally in respect of the closing action of jaws 17L, 17R as indicated by the orthogonal double headed arrows X and Y in FIG. $4C_1$ where arrow X shows the opening and closing action of the jaws and the arrow Y the reciprocatory action of the cutting blade $16_1$ and plunger $16_2$; as shown the line of reciprocation is along Y and is normal to the closing or opening action X of the jaws.

It is also to be noted that jaws 17L, 17R are substantially symmetrical of centre line $A_1A_2$ of FIG. 1.

Cutting blade $16_1$ is forced by the action of piston 14 in the direction of arrow A3 (FIG. 1) and the lower arrow Y of FIG. $4C_1$ to slide in groove $17_3$ (FIG. $4C_{11}$) across the top of the crimp W1 to cut the wire W at W2 and part it from the crimp W1. The cutting blade $16_1$ then returns (upper arrow Y) under the action of return spring 15 once the air pressure is reduced and the jaws 17L, 17R then open ready for further action.

In FIG. 5 two jaws 18L, 18R co-operate in a head 19. Jaw 18R is fixed to the head at $18R_1$, $18R_2$. Jaw 18L (shown outside the head for convenience of description) is in use pivoted at $18L_1$ in head 19 via pivot hole $18L_2$. The jaw 18L is forced by any suitable means in a direction indicated by arrow A4 to close the jaws 18L, 18R.

A spring member 20 is fixed to jaw 18L at $18L_3$ and as the jaws 18L, 18R meet so the spring member is made to extend itself and so cuts a crimped wire between the said jaws 18L, 18R.

It is to be understood that the crimping and cutting tool of the invention may be actuated solely by hand via suitable linkages or similar means.

It is to be further understood from a consideration of FIG. $4C_{11}$ that the blade $16_1$ may, with but a small modification, cut the wire in the crimp W1 per se the blade moving in a groove in the end of the jaws where the thickness of the wire is much reduced by the crimp.

I claim:

1. A crimping and cutting tool, for wire, or the like, comprising: a pair of relatively movable jaws, means for closing said jaws in use to crimp a wire therebetween to form a crimping gap, said jaws also defining a surface located at the crimping gap and the said surface being shaped and oriented for defining a pathway across the wire being crimped at said crimping gap, a movable cutting blade and means for moving said blade along said surface for cutting the wire at said surface and at said jaws.

2. The crimping and cutting tool according to claim 1, wherein said jaws are connected with a reciprocating piston and are closed and opened by said reciprocating piston as it reciprocates.

3. The crimping and cutting tool according to claim 2 wherein the said piston is connected with and moves said cutting blade such that as said piston reciprocates to close said jaws, said piston also moves said blade along said surface.

4. The crimping and cutting tool according to claim 2, wherein said reciprocating piston reciprocates along a line that is substantially normal to the opening and closing action of said jaws and said jaws include means for converting the reciprocation of said piston into the opening and closing action of said jaws.

5. The crimping and cutting tool according to claim 3, wherein said reciprocating piston reciprocates along a line that is substantially normal to the opening and closing action of said jaws and said jaws include means for converting the reciprocation of said piston into the opening and closing action of said jaws.

6. The crimping and cutting tool according to claim 5, wherein said surface is oriented across the path of the reciprocation of said piston, such that reciprocation of said piston along one path moves said cutting blade along said surface.

7. The crimping and cutting tool according to claim 3, wherein said piston is of the type that is actuated by air pressure to close said jaws and there is a return spring to open said jaws when the air pressure is at least reduced on said piston.

8. The crimping and cutting tool according to claim 1, wherein said cutting blade is an extensible spring member that when gripped by said jaws extends and wipes along the said surface to cut in use the wire therebetween.

9. The crimping and cutting tool according to claim 1, wherein said surface is shaped and oriented for moving said blade along the length of said crimping gap.

10. The crimping and cutting tool according to claim 8, wherein said surface is defined in a gap that is defined in said jaws, through which said gap said spring member moves.

11. The crimping and cutting tool according to claim 8, wherein said reciprocating piston reciprocates along a line that is substantially normal to the opening and closing action of said jaws and said jaws include means for converting the reciprocation of said piston into the opening and closing action of said jaws, said surface being oriented across the path of the reciprocation of said piston, such that reciprocation of said piston along one path moves said cutting blade along said surface.

* * * * *